US005950943A

United States Patent [19]

Stehr

[11] Patent Number: 5,950,943

[45] Date of Patent: Sep. 14, 1999

[54] AGITATOR MILL

[75] Inventor: Norbert Stehr, Grünstadt, Germany

[73] Assignee: Draiswerke GmbH, Mannheim, Germany

[21] Appl. No.: 08/906,043

[22] Filed: Aug. 5, 1997

[30] Foreign Application Priority Data

Aug. 14, 1996 [DE] Germany ..... 196 32 757

[51] Int. Cl.[6] ..... B02C 17/16

[52] U.S. Cl. ..... 241/171; 241/172

[58] Field of Search ..... 241/170, 172, 241/152.1, 153, 171

[56] References Cited

U.S. PATENT DOCUMENTS

| | | | |
|---|---|---|---|
| 4,225,092 | 9/1980 | Matter et al. | 241/46 |
| 4,496,106 | 1/1985 | Gross | 241/46.17 |
| 4,715,547 | 12/1987 | Buhler | 241/176 |
| 5,062,577 | 11/1991 | Schmitt et al. | 241/171 |
| 5,076,506 | 12/1991 | Inoue | 241/171 |
| 5,133,508 | 7/1992 | Stehr et al. | 241/171 |
| 5,346,145 | 9/1994 | Kamiwano et al. | 241/172 |
| 5,590,841 | 1/1997 | Stein et al. | 241/171 |

FOREIGN PATENT DOCUMENTS 2074895 11/1981 United Kingdom .

OTHER PUBLICATIONS

Abstract of Document DE 40 10 926 A.

*Primary Examiner*—Mark Rosenbaum
*Attorney, Agent, or Firm*—Browdy and Neimark

[57] ABSTRACT

An agitator mill comprises an annular cylindrical exterior grinding chamber, which is defined by an interior wall of a grinding receptacle and an outer wall of a rotor, and an interior grinding chamber, which is defined by an inner wall of the rotor and an outer jacket of an interior stator. The grinding chambers are connected with each other by a deflection chamber. The walls defining the grinding chambers are smooth, free from agitator elements.

19 Claims, 6 Drawing Sheets

AGITATOR MILL

BACKGROUND OF THE INVENTION

1. Field of the Invention

The invention relates to an agitator mill for the treatment of free flowing grinding stock, comprising a grinding receptacle, an interior wall of which defines a substantially closed grinding chamber; and an agitator unit, which is disposed rotatingly drivably in the grinding receptacle and is cup-shaped relative to a common central longitudinal axis and which comprises an annular cylindrical rotor, within which an interior stator is disposed, tightly joined to the grinding receptacle; an annular cylindrical exterior grinding chamber being formed between the interior wall of the grinding receptacle and an outer wall of the rotor, and an annular cylindrical interior grinding chamber, which is disposed coaxially within the exterior grinding chamber and is connected with the latter by way of a deflection chamber, being formed between an inner wall of the rotor and an outer jacket of the interior stator; the exterior grinding chamber, the deflection chamber and the interior grinding chamber constituting the grinding chamber partially filled with auxiliary grinding bodies; a grinding-stock supply chamber, which is disposed upstream of the exterior grinding chamber and opens into the latter in the direction of flow of the grinding stock, and a separating device, which is disposed downstream of the interior grinding chamber in the direction of flow of the grinding stock, being disposed approximately on the same side of the grinding receptacle for the grinding stock to pass through; and bypasses being provided in the agitator unit for the return of the auxiliary grinding bodies from the vicinity of the separating device into the vicinity of grinding-stock supply chamber, the bypasses connecting the end of the interior grinding chamber with the beginning of the exterior grinding chamber and—related to the direction of flow of the grinding stock—being disposed upstream of the separating device.

2. Background Art

An agitator mill of the generic type is known from U.S. Pat. No. 5,062,577. In this known agitator mill, pin-type agitator elements are mounted on the limiting walls of the exterior grinding chamber and at least on the inner limiting wall of the interior grinding chamber, by means of which alternate acceleration and deceleration of the auxiliary grinding bodies takes place, which leads to a turbulent-flow condition having a grinding and dispersing effect predominantly by impact. The grinding stock flows through a grinding-stock supply chamber, through a transition portion, past the bypasses into the exterior grinding chamber, and through the deflection chamber into the interior grinding chamber. The auxiliary grinding bodies circulate through the exterior grinding chamber, the deflection chamber, the interior grinding chamber and the bypasses back into the exterior grinding chamber or the transition portion opening into the latter, respectively. The grinding stock flows from the end of the interior grinding chamber to the separating device. The separating device does not considerably serve to separate the auxiliary grinding bodies on the one hand from the grinding stock on the other; nevertheless, the term separating device is used in this application too, because it is generally accepted in the technical language. As results from the above explanation, separating the auxiliary grinding bodies from the grinding stock takes place takes place already upstream of the separating device. The known agitator mill has been extraordinarily successful in practice.

An agitator mill is known from U.S. Pat. No. 4,304,362, of which the exterior grinding chamber on the one hand and the interior grinding chamber on the other each taper in the shape of a truncated cone, i.e. the cross-section of the grinding chamber is conical on each side of the central longitudinal axis of the rotor and the stator. The grinding stock flows through the agitator mill from the inside to the outside, i.e. it flows into the interior grinding chamber where the latter has its narrowest diameter, then it passes through the radially expanding interior grinding chamber, the deflection chamber and the radially expanding exterior grinding chamber. From there, it flows radially inwards through a chamber unilaterally defined by the agitator element and towards a separating device, through which the grinding stock is discharged. The inlet of a bypass is disposed downstream of this separating device, the inlet of this bypass being disposed radially within the separating device, i.e. disposed downstream of the latter. From there, the auxiliary grinding bodies flow through bypasses in the rotor into the starting portion of the interior grinding chamber. The limiting walls of the grinding chamber are smooth. The width of the grinding gap, i.e. the radial with of the grinding chamber, is constant; however, the distance towards the axis of rotation increases permanently. This results in the fact that the shear gradient increases from the inside to the outside along the path of the grinding stock. This means that either it is too low in the interior grinding chamber or too high in the exterior grinding chamber, which leads to irregular load exerted on the grinding stock. (The shear gradient is defined as the quotient of the speed of the rotating surface and the gap width.)

SUMMARY OF THE INVENTION

It is the object of the invention to embody the agitator mill of the generic type in such a way that grinding and dispersing takes place predominantly by shearing effects and that the agitator mill is especially convenient in cleaning.

According to the invention, this object is attained by the features which consist in that the exterior grinding chamber has the shape of an annular gap with an exterior-grinding-gap width c, and in that the interior grinding chamber has the shape of an annular gap with an interior-grinding-gap width e, and in that the interior wall of the grinding receptacle, the outer wall of the rotor, the inner wall of the rotor and the outer jacket of the interior stator are smooth, free from agitator elements. The annular-gap-type design of the exterior grinding chamber and the interior grinding chamber reduces the volume of the grinding chamber, which leads to a reduction of the cleaning requirements. The smooth design of the cylindrical limiting walls of the exterior grinding chamber and the interior grinding chamber produces a flow in which the auxiliary grinding bodies are moved in layers relative to each other. The smooth limiting walls are easy to clean. In any case, the shear gradient and thus the local intensity of load is constant over the respective grinding chamber height in the exterior grinding chamber on the one hand and in the interior grinding chamber on the other. When the interior-grinding-gap width is smaller than the exterior-grinding-gap width, then the shear gradient can be made the same in the exterior grinding chamber and in the interior grinding chamber; it is then constant virtually over the entire grinding path. The precise dimensioning of the interior-grinding-gap width in relation to the exterior-grinding-gap width results from the above definition of the shear gradient.

Corresponding to the advantageous embodiments in which the deflection chamber has an extension d parallel to the axis to which $c<d\leqq 3c$ applies in relation to the exterior-grinding-gap width c, and in particular in which the deflection chamber has an extension d parallel to the axis to which $2c \leqq d \leqq 3c$ applies in relation to the exterior-grinding-gap width c, the deflection chamber can serve as a buffer volume for the auxiliary grinding bodies. The cross-section of the deflection chamber, which is enlarged as compared with the cross-section of the exterior grinding chamber, facilitates the flow of the grinding stock and in particular of the auxiliary grinding bodies radially inwards into the interior grinding chamber against the centrifugal force. If a kind of a recess in the agitator element is formed in the transition poltion into which open the bypasses, this produces a clearance serving to reduce wear.

Further features, advantages and details of the invention will become apparent from the ensuing description of exemplary embodiments of the invention, taken in conjunction with the drawing.

DESCRIPTION OF THE PREFERRED EMBODIMENTS

Figure 1:
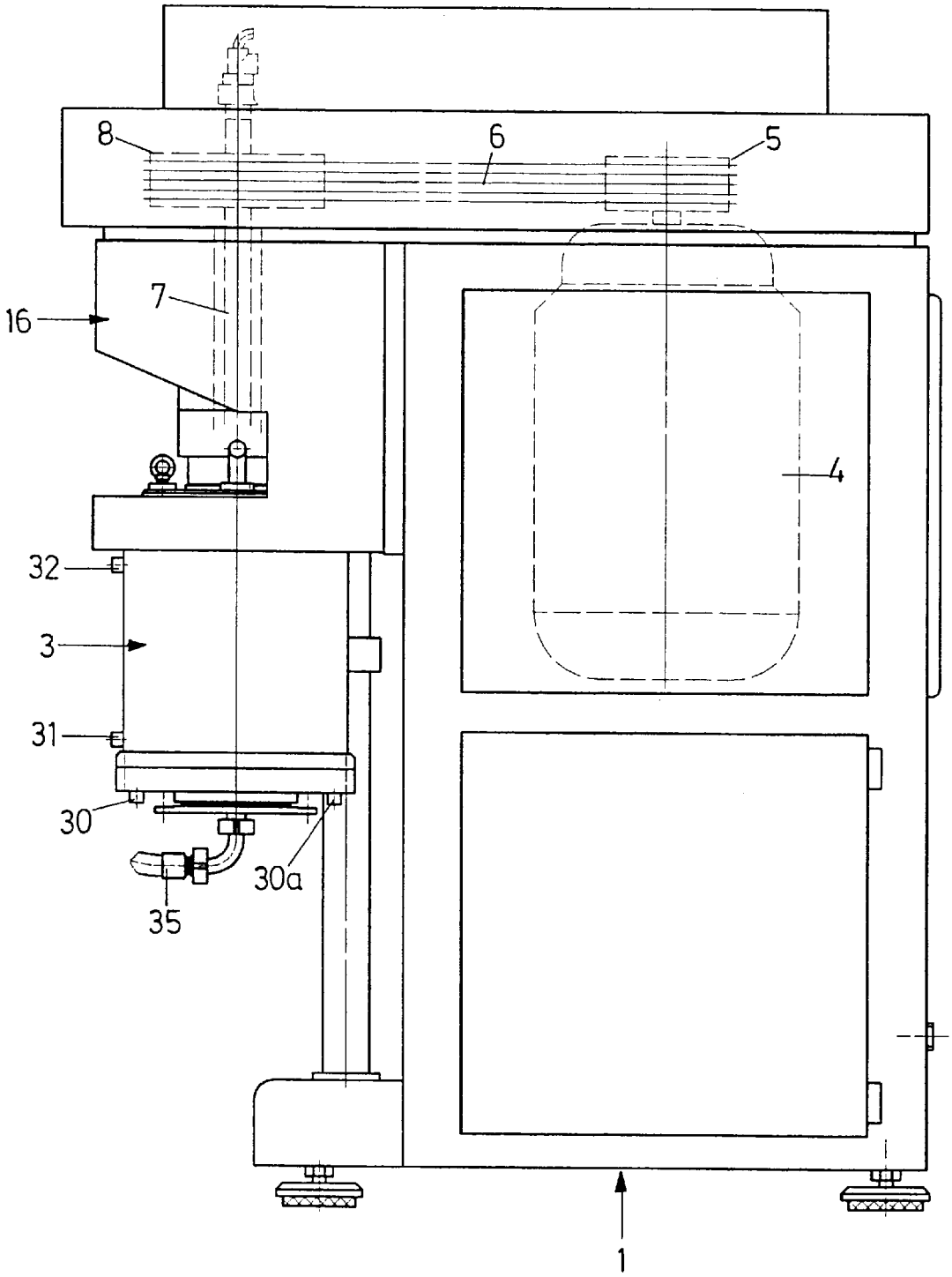
FIG. 1 is an conventional diagrammatic representation of a lateral view of an agitator mill.

The agitator mill seen in FIG. 1 conventionally comprises a stand 1 on which to mount a cylindrical grinding receptacle 3. An electric drive motor 4 is housed in the stand 1 and provided with a V-belt pulley 5, by which a V-belt pulley 8, fixed against rotation on a drive shaft 7, can be driven to rotate by belts 6.

Figure 2:
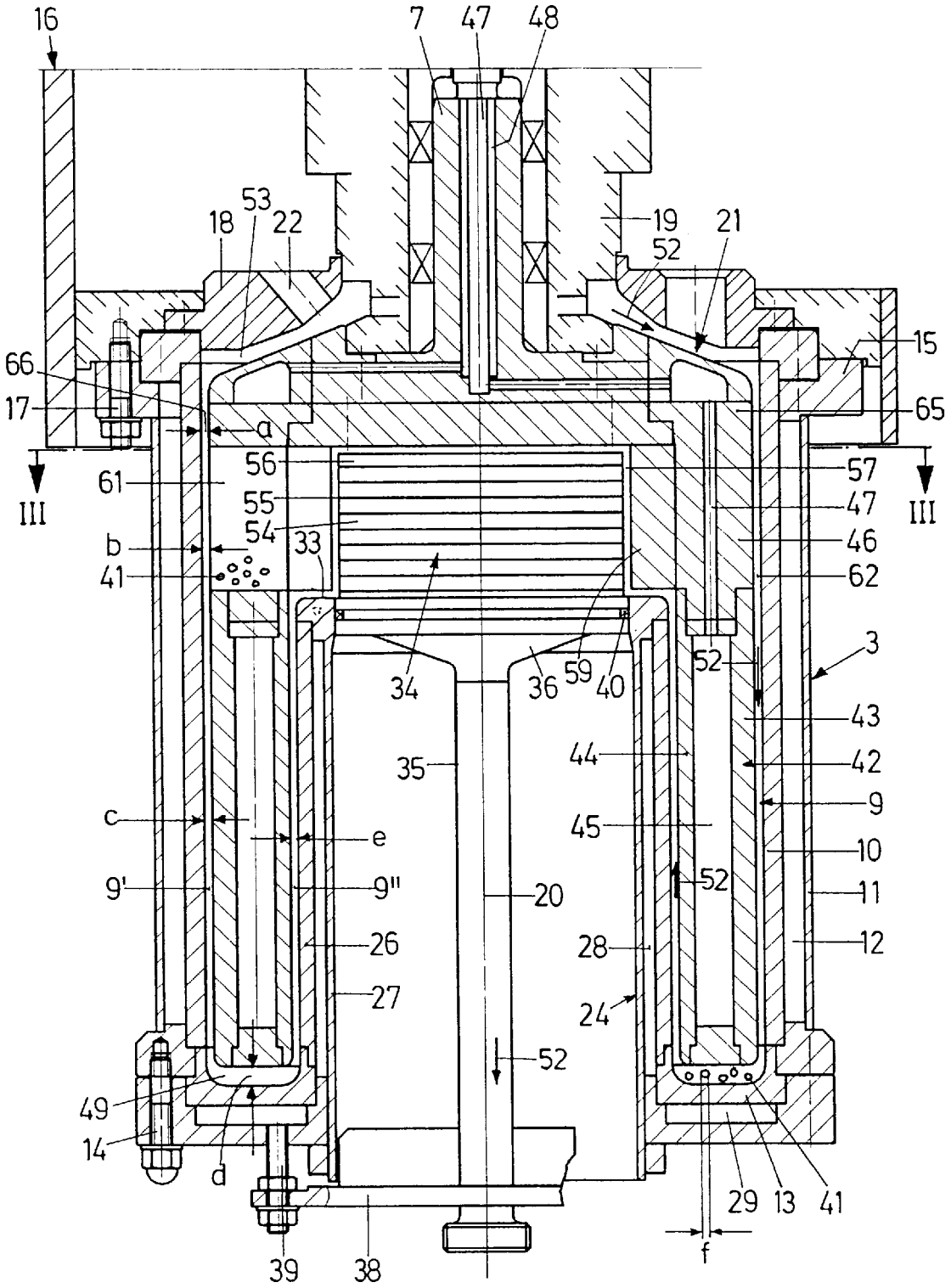
FIG. 2 is a lengthwise section through a first embodiment of a grinding receptacle of the agitator mill.

As becomes apparent in particular from FIG. 2, the grinding receptacle 3 comprises a cylindrical interior wall 10 which encloses a grinding chamber 9 and which is surrounded by a substantially cylindrical outer jacket 11. The interior cylinder 10 and the outer jacket 11 define a cooling chamber 12 between them. The lower part of the grinding chamber 9 is terminated by a toroidal bottom plate 13 which is fixed on the grinding receptacle by screws 14.

The grinding receptacle 3 comprises an upper annular flange 15, by means of which it is fixed to the lower side of a carrying housing 16 by way of screws 17, the carrying housing 16 being mounted on the stand 1 of the agitator mill. The grinding chamber 9 is closed by means of a cover 18. The carrying housing 16 comprises a central bearing and sealing housing 19 which is disposed coaxially with the central longitudinal axis 20 of the grinding receptacle 3. The drive shaft 7 which is likewise coaxial with the axis 20 and on which an agitator element 21 is mounted passes through this sealing housing 19. A grinding-stock supply line 22 opens into the portion of the sealing housing 19 which adjoins the grinding chamber 9.

An approximately cup-shaped, cylindrical interior stator 24, which projects into the grinding chamber 9, is mounted on the toroidal bottom plate 13; it comprises a cylindrical outer jacket 26 coaxial with the axis 20 and a cylindrical inner jacket 27 likewise coaxial with the axis 20. The outerjacket 26 and the inner jacket 27 define a cooling chamber 28 between them. The cooling chamber 28 is connected with a cooling chamber 29 in the bottom plate 13, cooling water being supplied to the cooling chamber 29 by way of a cooling-water supply connector 30 and discharged by way of an outlet connector 30=a. Cooling water is supplied to the cooling chamber 12 of the grinding receptacle 3 by way of a cooling-water supply connector 31 and discharged by way of a cooling-water discharge connector 32.

On the upper face 33, located above the grinding chamber 9, of the interior stator 24, provision is made for a grinding-stock/auxiliary-grinding-body separating device 34 which is connected with a grinding-stock discharge line 35. A grinding-stock collecting hopper 36 is provided between the separating device 34 and the discharge line 35. In the vicinity of the bottom plate 13, the discharge line 35 is provided with a holding bow 38 which, by means of screws 39, is releasably joined to the bottom plate 13 and the interior stator 24 that is tightly joined to the latter. The separating device 34 is sealed towards the annular face 33 of the interior stator 24 by means of a seal 40 and, together with the discharge line 35 and the collecting hopper 36, can be pulled downwards out of the interior stator 24 once the screws 39 are unscrewed. The separating device 34 can pulled out of the grinding chamber 9 without the auxiliary grinding bodies 41 that are housed in the latter having to be removed, because the filling of the grinding chamber 9 with these auxiliary grinding bodies 41 does not reach as far as to the face 33 when the agitator element 21 is not driven.

The basic structure of the agitator element 21 is cup-shaped, i.e. the agitator element 21 has a substantially annular cylindrical rotor 42 which is formed by a cylindrical outer wall 43 and a cylindrical inner wall 44 disposed coaxially thereto and coaxially to the axis 20. A cooling chamber 45 is formed between the outer wall 43 and the inner wall 44 of the rotor 42. The rotor 42 is mounted on a rotor carrying member 46 which is connected with the shaft 7. The supply of cooling water to and the latter's discharge from the cooling chamber 45 takes place by way of cooling-water channels 47, 48 formed in the shaft 7 and in the rotor carrying member 46. By means of the smooth interior cylinder 10 of the grinding receptacle 3 and the smooth, cylindrical outer wall 43 of the rotor 42 on the one hand and by means of the cylindrical, smooth inner wall 44 of the rotor 42 and the cylindrical, smooth outer jacket 26 of the interior stator 24 on the other hand, the grinding chamber 9 is divided into a cylindrical exterior grinding chamber 9' on the one hand and a cylindrical interior grinding chamber 9" on the other, which are connected with each other by a deflection chamber 49 in the vicinity of the bottom plate 13. No agitator elements projecting into the exterior grinding chamber 9' or into the interior grinding chamber 9" are mounted on the grinding-chamber limiting walls formed by the interior cylinder 10, the outer wall 43, the inner wall 44 and the outer jacket 26. The grinding stock flows through the grinding chamber 9 in accordance with the arrows of flow direction 52, coming from the grinding-stock supply line 22 and passing through a grinding-stock supply chamber 53 between the rotor carrying member 46 on the one hand and the cover 18 and the adjacent portion of the inner wall 10 on the other hand, then downwards through the exterior grinding chamber 9', radially inwards through the deflection chamber 49, and from there upwards through the interior grinding chamber 9" as far as to the separating device 34. On its way through the exterior grinding chamber 9', the deflection chamber 49 and the interior grinding chamber 9", the grinding stock is ground while the agitator unit 21 is driven in rotation, cooperating with the auxiliary grinding bodies 41. The grinding stock leaves the grinding chamber 9 through the separating device 34, from where it is discharged through the grinding-stock discharge line 35.

Figure 3:
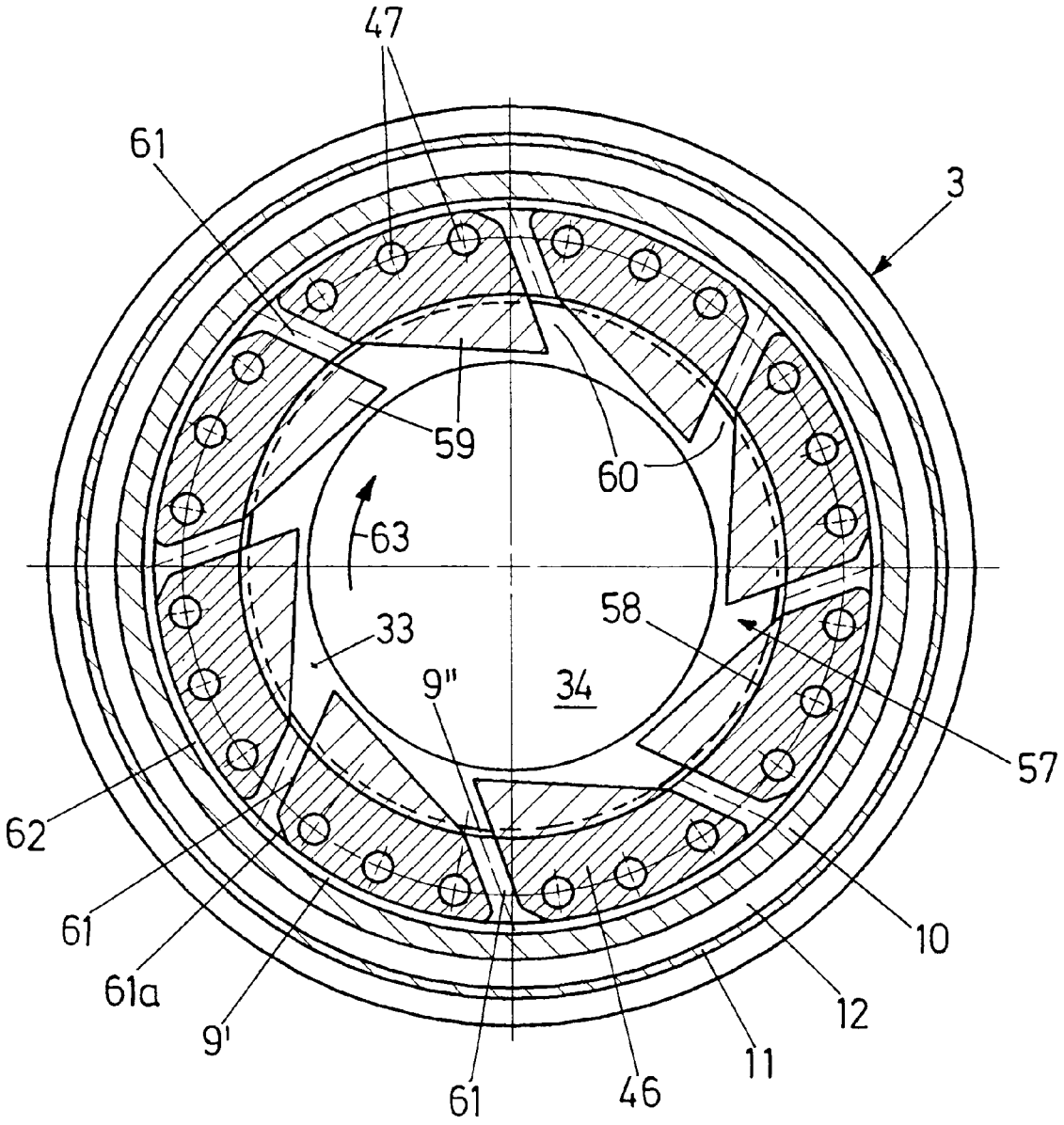
FIG. 3 is a cross-sectional view through the grinding receptacle on the section line III—III of FIG. 2.

As seen in FIGS. 2 and 3, the cylindrical separating device 34 comprises a stack of annular disks 54, a separating gap 55 being left free between each of them; the width of the gap 55 is often less than the diameter of the smallest auxiliary grinding bodies 41 used. However, the width may also exceed this diameter, since the segregation of the auxiliary grinding bodies 41 often takes place before the separating device 34 is reached. Frontally, this stack of annular disks 54 is terminated by a closing plate 56. The separating device 34 is disposed in a cylindrical recess 57 of the rotor carrying member 46. Between the cylindrical wall 58 of the recess 57 and the separating device 34, elongated drivers 59 are mounted on the wall 58, which are approximately triangular in cross-sectional shape and which, between themselves, form inlet portions 60 of approximately hopper-type cross-sectional shape for bypasses 61. A design of this type with these drivers 59 is known from U.S. Pat. No. 5,133,508.

The bypasses 61 are situated in the rotor carrying member 46, i.e.—as seen in FIG. 3—in the portion of transition of the rotor carrying member 46 to the cylindrical rotor 42 and—seen in the direction of the arrows of flow direction 52—before the separating device 34. Related to the flow direction corresponding to the arrows of flow direction 52, they connect the end of the interior grinding chamber 9" with the beginning of the exterior grinding chamber 9', i.e. with a transition portion 62 of the grinding-stock supply chamber 53 which passes into the exterior grinding chamber 9'. Related to the direction of rotation 63 of the agitator unit 21, these inlet portions 60 and the bypasses 61 extend radially from the inside to the outside against the direction of rotation 63 so that the auxiliary grinding bodies 41, which are provided with centrifugal acceleration in the interior grinding chamber 9", are catapulted off through the inlet portions 60 and the bypasses 61 and thus returned again into the grinding-stock supply chamber 53. As seen in FIG. 2, the drivers 59 overlap the face 33 of the interior stator 24. The inlet portions 60 are open downwards towards the interior grinding chamber 9" so that the drivers 59 in the inlet portion 60 form a kind of conveying blades which catapult the auxiliary grinding bodies 41 outwards before the separating device 34 is reached and return them into the transition portion 62 between the grinding-stock supply chamber 53 and the exterior grinding chamber 9'. As roughly outlined above, the exterior grinding chamber 9' and the interior grinding chamber 9" are grinding gaps; this is true for all the embodiments according to FIGS. 2 to 6. Above the transition portion 62, the rotor carrying member 46 has a cylindrical section 65, an annular cylindrical closing gap 66 of a gap width a being formed between the section 65 and the facing portion of the inner wall 10 of the grinding receptacle 3.

The transition portion 62, which is also annular cylindrical and extends around the bypasses 61 concentrically of the axis 20, has a radial width b related to the axis 20. The exterior grinding chamber 9' is also annular cylindrical and has an exterior-grinding-gap width c. The deflection chamber 49 exhibits an extension d parallel to the axis 20. By appropriate selection of this extension d, the deflection chamber 49 becomes a buffer zone for the auxiliary grinding bodies 41.

The interior grinding chamber 9", which also has the shape of an annular gap, exhibits an interior-grinding-gap width e radially to the axis 20.

As regards the exterior-grinding-gap width c, $2.0\ \text{mm} \leqq c \leqq 10\ \text{mm}$ and preferably $3.0\ \text{mm} \leqq c \leqq 6.0\ \text{mm}$ applies, the selection of the exterior-grinding-gap width c being determined among other things by the size of the auxiliary grinding bodies 41, the diameter f of which being in the range of 0.2 to 1.0 and in a borderline case up to 2.0 mm. Coordinating the exterior-grinding-gap width c with regard to the dimension or the diameter f, respectively, of the auxiliary grinding bodies 41 takes place in such a way that the desired shearing processes, i.e. the desired grinding effects, occur in the gap-type exterior grinding chamber 9' and correspondingly in the gap-type interior grinding chamber 9", the smooth limiting walls of the exterior grinding chamber 9' and the interior grinding chamber 9" by adhesion exercising the required driving forces on the auxiliary grinding bodies 41 and the grinding stock. In the gap-type exterior grinding chamber 9' and in the gap-type interior grinding chamber 9", a regularly laminar flow similar to a Couette flow is produced between the stationary and the moved limiting wall. This results in the fact that commi-nution and dispersion of the grinding stock are preferably effected by a shearing mechanism.

As regards the gap width a, $0.4c \leqq a \leqq 0.8c$ applies.

The gap width a of the closing gap 66 should always be smaller than the exterior-grinding-gap width c so that the auxiliary grinding bodies 41 do not reach the upper portion of the grinding-stock supply chamber 53, but, in any case, enter the exterior grinding chamber 9'. The shearing load in the closing gap 66 is higher than it is in the exterior grinding chamber 9', owing to the gap width a being smaller as compared to the exterior-grinding-gap width c, so that the local shear gradient in the closing gap 66 is higher than in the exterior grinding chamber 9'. Since the auxiliary grinding bodies 41 tend to escape the higher shear gradient, supported by the driving effect they flow reliably into the exterior grinding chamber 9' through the grinding stock that flows in.

As compared to the exterior-grinding-gap width c, $c \leqq b \leqq 3c$ and preferably $2c \leqq b \leqq 3c$ applies to the width b of the transition portion 62.

When the radial width b of the transition portion 62 exceeds the exterior-gap-width c, considerable reduction of wear at the outlet edge 61*a* of the bypasses 61 occurs in this area, because the transition portion 62 constitutes a certain clearance zone for the auxiliary grinding bodies 41. Moreover, the impact of the auxiliary grinding bodies on the interior wall 10 is attenuated.

As compared to the exterior-grinding-gap width c, $0.5c \leqq e < c$ applies to the interior-grinding-gap width e.

If the shear gradient is to be the same in the exterior grinding chamber 9' and the interior grinding chamber 9", then $e<c$ must apply.

As for the extension d of the deflection chamber 49 in relation to the exterior-grinding-gap width c, $c < d \leqq 3c$ and preferably $2c \leqq d \leqq 3c$ applies.

The greater d within the given range, the greater is the buffer volume formed in the deflection chamber 49 for the auxiliary grinding bodies and the more easily will the grinding stock and in particular the auxiliary grinding bodies 41 flow radially inwards against the centrifugal force towards the interior grinding chamber 9". The smaller d within the given range, the stronger is the grinding effect in this area.

As for the diameter f of the auxiliary grinding bodies 41, $2f \leqq c \leqq 10f$ and preferably $3f \leqq c \leqq 6f$ applies.

FIGS. 2 and 3 show an embodiment to which $a=0.8c$ $b=c=e$ and $d=2c$ applies.

Figure 4:
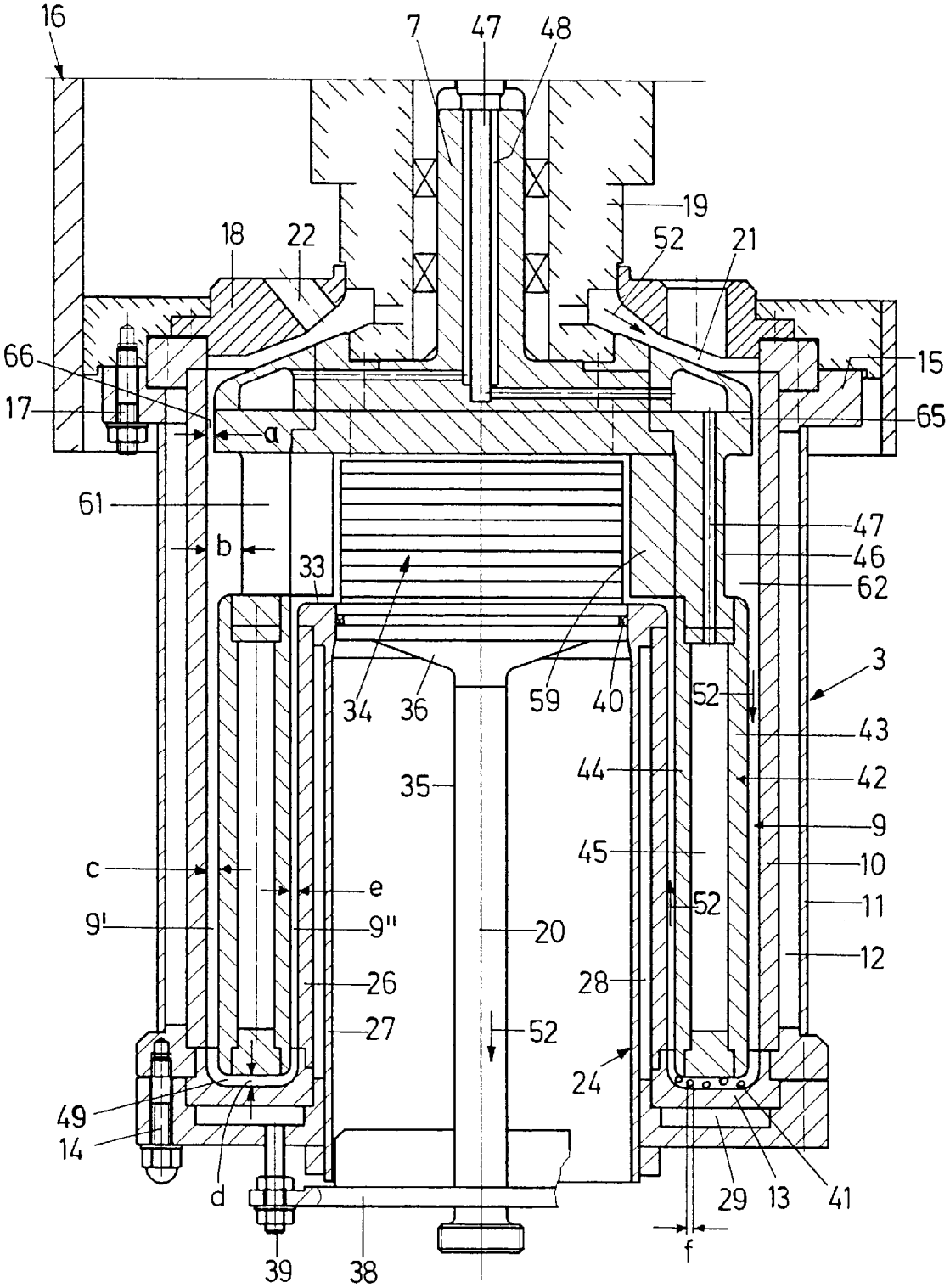
FIG. 4 is a lengthwise section through a second embodiment of a grinding receptacle of the agitator mill.

As opposed to this, $a=0.5c$ $b=3c$ $c=d$ and $e=0.7c$ applies to the embodiment according to the FIG. 4.

Figure 5:
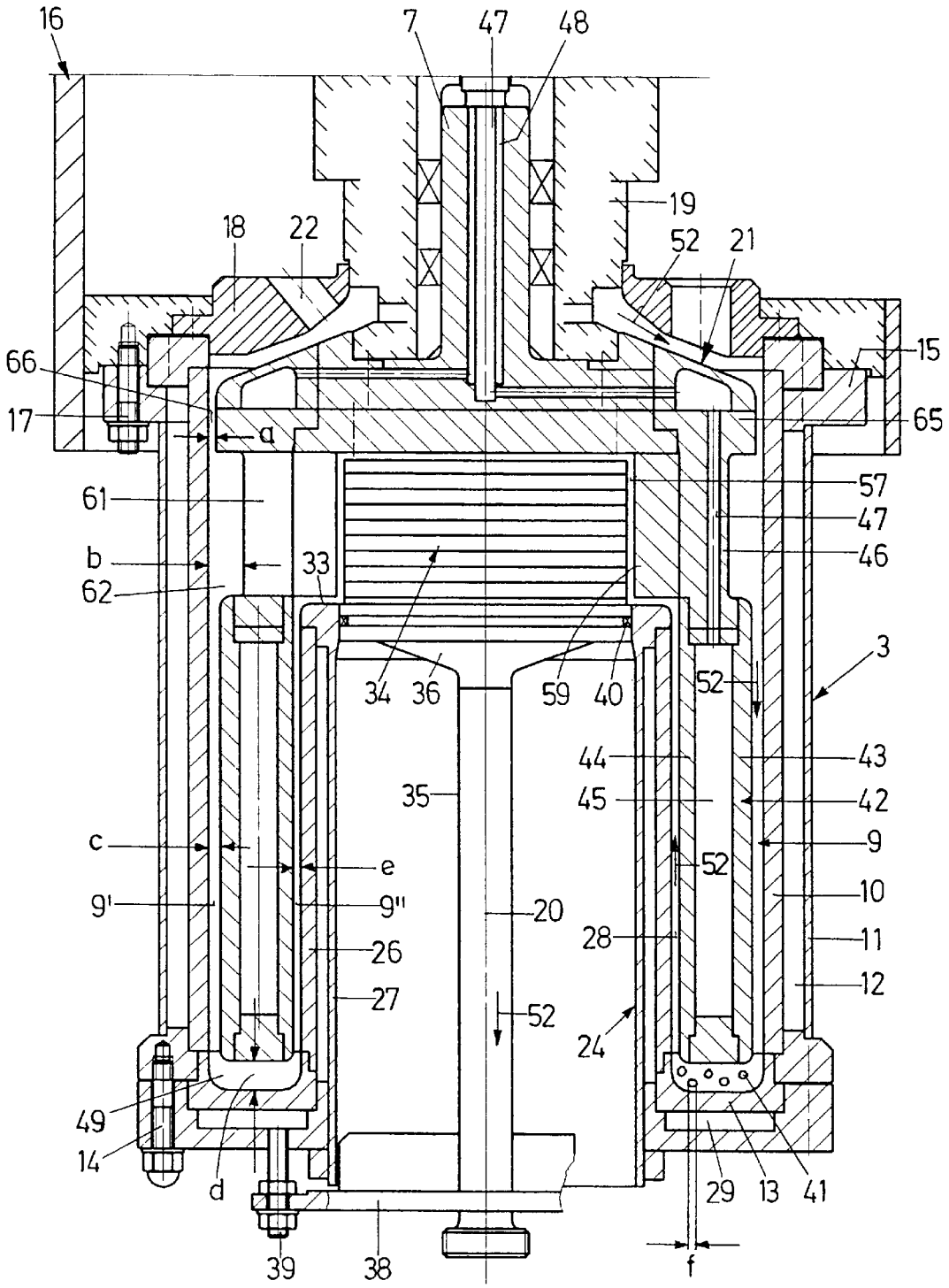
FIG. 5 is a lengthwise section through a third embodiment of a grinding receptacle of the agitator mill.

$a=0.5c$ $b=3c$ $d=2.5c$ and $e=0.7c$ applies to the embodiment according to FIG. 5.

Figure 6:
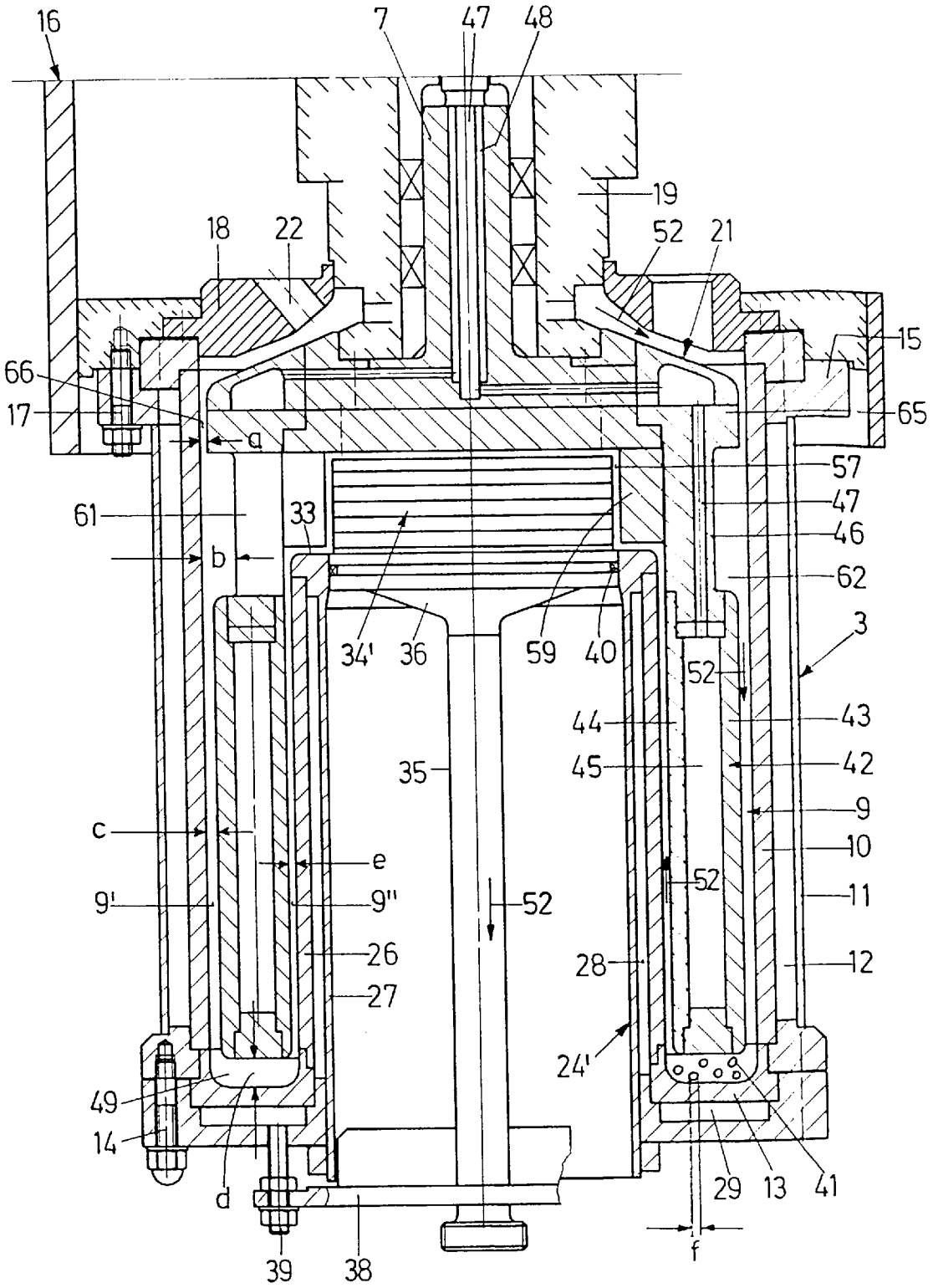
FIG. 6 is a lengthwise section through a fourth embodiment of the grinding receptacle of the agitator mill.

In the embodiment according to FIG. 6, the interior stator 24' is moved further upward, the separating device 34' being correspondingly shortened axially, so that in the vicinity of its face 33, the interior stator 24' partially overlaps the bypasses 61 in the direction of the axis 20. The inlet portion 60' is correspondingly shortened in the direction of the axis 20. In this case, $a=0.5c$ $b=3c$ $d=2.5c$ and $e=0.7c$ applies.

What is claimed is:

1. An agitator mill for the treatment of free flowing grinding stock, comprising a grinding receptacle (3), an interior wall (10) of which defines a substantially closed grinding chamber (9); and an agitator unit (21), which is disposed rotatingly drivably in the grinding receptacle (3) and is cup-shaped relative to a common central longitudinal axis (20) and which comprises an annular cylindrical rotor (42), within which an interior stator (24) is disposed, tightly joined to the grinding receptacle (3); an annular cylindrical exterior grinding chamber (9') being formed between the interior wall of the grinding receptacle (3) and an outer wall (43) of the rotor (42), and an annular cylindrical interior grinding chamber (9"), which is disposed coaxially within the exterior grinding chamber (9') and is connected with the latter by way of a deflection chamber (49), being formed between an inner wall (44) of the rotor (42) and an outer lacket (26) of the interior stator (24); the exterior grinding chamber (9'), the deflection chamber (49) and the interior grinding chamber (9") constituting the grinding chamber (9) partially filled with auxiliary grinding bodies (41); a grinding-stock supply chamber (53), which is disposed upstream of the exterior grinding chamber (9') and opens into the latter in the direction of flow (52) of the grinding stock, and a separating device (34, 34'), which is disposed downstream of the interior grinding chamber (9") in the direction of flow (52) of the grinding stock, being disposed approximately on the same side of the grinding receptacle for the grinding stock to pass through; and bypasses (61, 61') being provided in the agitator unit (21) for the return of the auxiliary grinding bodies (41) from the vicinity of the separating device (34, 34') into the vicinity of grinding-stock supply chamber (53), the bypasses (61, 61') connecting the end of the interior grinding chamber (9") with the beginning of the exterior grinding chamber (9') and—related to the direction of flow (52) of the grinding stock—being disposed upstream of the separating device (34, 34'), wherein the exterior grinding chamber (9') has the shape of an annular gap with an exterior-grinding-gap width c, and wherein the interior grinding chamber (9") has the shape of an annular gap with an interior-grinding-gap width e, and wherein the interior wall (10) of the grinding receptacle (3), the outer wall (43) of the rotor (42), the inner wall (44) of the rotor (42) and the outer jacket (26) of the interior stator (24) are smooth, free from agitator elements, wherein $0.5c \leqq e < c$ applies to the interior-grinding-gap width e in relation to the exterior-grinding-gap width c.

2. An agitator mill according to claim 1, wherein $2.0\ \text{mm} \leqq c \leqq 10.0\ \text{mm}$ applies to the exterior-grinding-gap width c.

3. An agitator mill according to claim 1, wherein $3.0\ \text{mm} \leqq c \leqq 6.0\ \text{mm}$ applies to the exterior-grinding-gap width c.

4. An agitator mill for the treatment of free flowing grinding stock, comprising a grinding receptacle (3), an interior wall (10) of which defines a substantially closed grinding chamber (9); and an agitator unit (21), which is disposed rotatingly drivably in the grinding receptacle (3) and is cup-shaped relative to a common central longitudinal axis (20) and which comprises an annular cylindrical rotor (42), within which an interior stator (24) is disposed, tightly joined to the grinding receptacle (3); an annular cylindrical exterior grinding chamber (9') being formed between the interior wall of the grinding receptacle (3) and an outer wall (43) of the rotor (42), and an annular cylindrical interior grinding chamber (9"), which is disposed coaxially within the exterior grinding chamber (9') and is connected with the latter by way of a deflection chamber (49), being formed between an inner wall (44) of the rotor (42) and an outer jacket (26) of the interior stator (24); the exterior grinding chamber (9'), the deflection chamber (49) and the interior grinding chamber (9") constituting the grinding chamber (9) partially filled with auxiliary grinding bodies (41); a grinding-stock supply chamber (53), which is disposed upstream of the exterior grinding chamber (9') and opens into the latter in the direction of flow (52) of the grinding stock, and a separating device (34, 34'). which is disposed downstream of the interior grinding chamber (9") in the direction of flow (52) of the grinding stock, being disposed approximately on the same side of the grinding receptacle for the grinding stock to pass through; and bypasses (61, 61') being provided in the agitator unit (21) for the return of the auxiliary grinding bodies (41) from the vicinity of the separating device (34, 34') into the vicinity of grinding-stock supply chamber (53), the bypasses (61, 61') connecting the end of the interior grinding chamber (9") with the beginning of the exterior grinding chamber (9') and—related to the direction of flow (52) of the grinding stock—being disposed upstream of the separating device (34, 34'), wherein the exterior grinding chamber (9') has the shape of an annular gap with an exterior-grinding-gap width c, and wherein the interior grinding chamber (9") has the shape of an annular gap with an interior-grinding-gap width e, and wherein the interior wall (10) of the grinding receptacle (3), the outer wall (43) of the rotor (42), the inner wall (44) of the rotor (42) and the outer lacket (26) of the interior stator (24) are smooth, free from agitator elements, wherein the deflection chamber (49) has an extension d parallel to the axis (20), to which $c<d\leqq 3c$ applies in relation to the exterior-grinding-gap width c.

5. An agitator mill according to claim 4, wherein the deflection chamber (49) has an extension d parallel to the axis (20), to which $2c\leqq d\leqq 3c$ applies in relation to the exterior-grinding-gap width c.

6. An agitator mill for the treatment of free flowing grinding stock, comprising a grinding receptacle (3), an interior wall (10) of which defines a substantially closed grinding chamber (9); and an agitator unit (21), which is disposed rotatingly drivably in the grinding receptacle (3) and is cup-shaped relative to a common central longitudinal axis (20) and which comprises an annular cylindrical rotor (42), within which an interior stator (24) is disposed, tightly joined to the grinding receptacle (3); an annular cylindrical exterior grinding chamber (9') being formed between the interior wall of the grinding receptacle (3) and an outer wall (43) of the rotor (42), and an annular cylindrical interior grinding chamber (9"), which is disposed coaxially within the exterior grinding chamber (9') and is connected with the latter by way of a deflection chamber (49), being formed between an inner wall (44) of the rotor (42) and an outer jacket (26) of the interior stator (24); the exterior grinding chamber (9'), the deflection chamber (49) and the interior grinding chamber (9") constituting the grinding chamber (9) partially filled with auxiliary grinding bodies (41); a grinding-stock supply chamber (53), which is disposed upstream of the exterior grinding chamber (9') and opens into the latter in the direction of flow (52) of the grinding stock, and a separating device (34, 34'). which is disposed downstream of the interior grinding chamber (9") in the direction of flow (52) of the grinding stock, being disposed approximately on the same side of the grinding receptacle for the grinding stock to pass through; and bypasses (61, 61') being provided in the agitator unit (21) for the return of the auxiliary grinding bodies (41) from the vicinity of the separating device (34, 34') into the vicinity of grinding-stock supply chamber (53), the bypasses (61, 61') connecting the end of the interior grinding chamber (9") with the beginning of the exterior grinding chamber (9') and—related to the direction of flow (52) of the grinding stock—being disposed upstream of the separating device (34, 34'). wherein the exterior grinding chamber (9') has the shape of an annular gap with an exterior-grinding-gap width c, and wherein the interior grinding chamber (9") has the shape of an annular gap with an interior-grinding-gap width e, and wherein the interior wall (10) of the grinding receptacle (3), the outer wall (43) of the rotor (42), the inner wall (44) of the rotor (42) and the outer jacket (26) of the interior stator (24) are smooth, free from agitator elements, wherein the bypasses (61, 61') open into a transition portion (62) of the grinding-stock supply chamber (53) where it passes into the exterior grinding chamber (9'), $c<b\leqq 3c$ applying to a width b of the transition portion (62) in relation of the exterior-grinding-gap width c.

7. An agitator mill for the treatment of free flowing grinding stock, comprising a grinding receptacle (3), an interior wall (10) of which defines a substantially closed grinding chamber (9); and an agitator unit (21), which is disposed rotatinqly drivably in the grinding receptacle (3) and is cupshaped relative to a common central longitudinal axis (20) and which comprises an annular cylindrical rotor (42), within which an interior stator (24) is disposed, tightly joined to the grinding receptacle (3); an annular cylindrical exterior grinding chamber (9') being formed between the interior wall of the grinding receptacle (3) and an outer wall (43) of the rotor (42), and an annular cylindrical interior grinding chamber (9"), which is disposed coaxially within the exterior grinding chamber (9') and is connected with the latter by way of a deflection chamber (49), being formed between an inner wall (44) of the rotor (42) and an outer jacket (26) of the interior stator (24); the exterior grinding chamber (9'), the deflection chamber (49) and the interior grinding chamber (9") constituting the grinding chamber (9) partially filled with auxiliary grinding bodies (41); a grinding-stock supply chamber (53), which is disposed upstream of the exterior grinding chamber (9') and opens into the latter in the direction of flow (52) of the grinding stock, and a separating device (34, 34'), which is disposed downstream of the interior grinding chamber (9") in the direction of flow (52) of the grinding stock, being disposed approximately on the same side of the grinding receptacle for the grinding stock to pass through; and bypasses (61, 61') being provided in the agitator unit (21) for the return of the auxiliary grinding bodies (41) from the vicinity of the separating device (34, 34') into the vicinity of grinding-stock supply chamber (53), the bypasses (61, 61') connecting the end of the interior grinding chamber (9") with the beginning of the exterior grinding chamber (9') and—related to the direction of flow (52) of the grinding stock—being disposed upstream of the separating device (34, 34'), wherein the exterior grinding chamber (9') has the shape of an annular gap with an exterior-grinding-gap width c, and wherein the interior grinding chamber (9") has the shape of an annular gap with an interior-grinding gap width e, and wherein the interior wall (10) of the grinding receptacle (3), the outer wall (43) of the rotor (42), the inner wall (44) of the rotor (42) and the outer jacket (26) of the interior stator (24) are smooth, free from agitator elements, wherein the agitator unit (21) comprises a cylindrical section (65), which—related to the direction of flow (52) of the grinding stock—is disposed before the bypasses (61, 61') and cooperates with the interior wall (10) of the grinding receptacle (3) to define an annular cylindrical closing gap (66), $0.4c\leqq a\leqq 0.8c$ applying to the gap width a of the cylindrical section (65) in relation to the exterior-grinding-gap width c.

8. An agitator mill according to claim 7, wherein the auxiliary grinding bodies (41 ) have a diameter f, to which $2f\leqq c\leqq 10f$ applies in relation to the exterior-grinding-gap width c.

9. An agitator mill according to claim 7, wherein $3f\leqq c\leqq 6f$ applies to a diameter f of the auxiliary grinding bodies (41) in relation to the exterior-grinding-gap width c.

10. An agitator mill according to claim 7, wherein the auxiliary grinding bodies (41) have a diameter f, to which $f \leqq 2.0$ mm applies.

11. An agitator mill according to claim 7, wherein $2.0 \text{ mm} \leqq c \leqq 10.0 \text{ mm}$ applies to the exterior-grinding-gap width c.

12. An agitator mill according to claim 11, wherein $3.0 \text{ mm} \leqq c \leqq 6.0 \text{ mm}$ applies to the exterior-grinding-gap width c.

13. An agitator mill according to claim 7, wherein $0.5c \leqq e < c$ applies to the interior-grinding-gap width e in relation to the exterior-grinding-gap width c.

14. An agitator mill according to claim 7, wherein the deflection chamber (49) has an extension d parallel to the axis (20), to which $c < d \leqq 3c$ applies in relation to the exterior-grinding-gap width c.

15. An agitator mill according to claim 14, wherein the deflection chamber (49) has an extension d parallel to the axis (20), to which $2c \leqq d \leqq 3c$ applies in relation to the exterior-grinding-gap width c.

16. An agitator mill according to claim 7, wherein the bypasses (61, 61') open into a transition portion (62) of the grinding-stock supply chamber (53) where it passes into the exterior grinding chamber (9'), $c \leqq b \leqq 3c$ applying to a width b of the transition portion (62) in relation of the exterior-grinding-gap width c.

17. An agitator mill according to claim 7, wherein the auxiliary grinding bodies (41) have a diameter f, to which $2f \leqq c \leqq 10f$ applies in relation to the exterior-grinding-gap width c.

18. An agitator mill according to claim 17, wherein $3f \leqq c \leqq 6f$ applies to the diameter f of the auxiliary grinding bodies (41) in relation to the exterior-grinding-gap width c.

19. An agitator mill according to claim 18, wherein the auxiliary grinding bodies (41) have a diameter f, to which $f \leqq 2.0$ mm applies.

* * * * *